US006978518B2

(12) United States Patent
Kim

(10) Patent No.: US 6,978,518 B2
(45) Date of Patent: Dec. 27, 2005

(54) RETAIL DISPLAY STRAP FOR SECURING A TIE TO A SHIRT

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 121 days.

(21) Appl. No.: 10/809,672

(22) Filed: Mar. 24, 2004

(65) Prior Publication Data

US 2004/0244155 A1 Dec. 9, 2004

Related U.S. Application Data

(63) Continuation-in-part of application No. 10/250,158, filed on Jun. 9, 2003, now Pat. No. 6,901,639.

(51) Int. Cl.[7] ..... B65D 63/00

(52) U.S. Cl. ..... 24/17 A; 24/16 PB; 24/30.5 P; 24/17 R

(58) Field of Search ..... 24/17 A, 17 R, 24/16 PB, 17 AP, 30.5 R, 30.5 P, 306; 220/682, 220/683, 686; 206/425; 223/71, 83

(56) References Cited

U.S. PATENT DOCUMENTS

| | | | | | |
|---|---|---|---|---|---|
| 520,145 | A * | 5/1894 | Newman | 24/17 A |
| 1,266,275 | A * | 5/1918 | Kelley | 24/17 A |
| 1,719,618 | A * | 7/1929 | Novick | 24/17 R |
| 1,829,613 | A * | 10/1931 | Sato | 24/17 R |
| 1,986,649 | A * | 1/1935 | Steele | 24/17 R |
| 2,004,098 | A * | 6/1935 | Andrews | 24/17 R |
| 2,081,242 | A * | 5/1937 | Long | 223/83 |
| 2,156,583 | A * | 5/1939 | Chaplin | 24/17 R |
| 2,204,004 | A * | 6/1940 | Steele | 223/83 |
| 2,286,181 | A * | 6/1942 | Steele | 24/17 R |
| 2,321,147 | A * | 6/1943 | Kennedy | 223/71 |
| 3,662,434 | A * | 5/1972 | Clayton | 24/30.5 P |
| 3,835,505 | A * | 9/1974 | Shewbridge | 24/16 R |
| 3,997,943 | A * | 12/1976 | Jones et al. | 24/30.5 P |
| 4,213,548 | A * | 7/1980 | Wood | 224/168 |
| 4,466,159 | A * | 8/1984 | Burrage | 24/16 PB |
| 4,942,644 | A * | 7/1990 | Rowley | 24/16 PB |
| 5,289,619 | A * | 3/1994 | Pileggi | 24/306 |

* cited by examiner

*Primary Examiner*—Robert J. Sandy
(74) *Attorney, Agent, or Firm*—Darby & Darby

(57) ABSTRACT

A tie is secured to a folded shirt of the type having a row of buttons by providing an elongated body having first and second ends, a first portion, a second portion, and a buttonhole through the first portion. The elongated body is wrapped around the folded shirt. The buttonhole is secured to one of the buttons of the row of buttons. The tie is disposed on the folded shirt, with one part of the tie being secured proximate to the collar, and another part depending downwardly along the row of buttons. The tie is placed over the first portion of the elongated body. The first and second ends can be attached at respective positions along the elongated body such that the second portion overlies the tie, the tie is seated between the first and second portions, and the tie is secured between the first and second positions.

8 Claims, 5 Drawing Sheets

RETAIL DISPLAY STRAP FOR SECURING A TIE TO A SHIRT

This application is a continuation-in-part of U.S. Ser. No. 10/250,158 filed Jun. 9, 2003, U.S. Pat. No. 6,901,639 B2 which is hereby incorporated by reference in its entirety.

BACKGROUND OF THE INVENTION

Retailers are discovering that shirt and tie combinations packaged together better meet the needs of a certain class of shoppers. When displaying and selling dress shirts in combination with ties, retailers assist their clients with a fashion choice that can be time consuming. Furthermore, when suitably coordinated, a shirt and a tie combination can make a more attractive display item for sale than if displayed individually.

Unfortunately, some consumers tend to remove and replace ties from their previously associated shirt, and thus create additional costs and difficulties to the retailer. Among other problems created, the individual components are not separately priced. Thus, retailers would benefit from a way to package shirt and tie combinations so that the consumer is discouraged from removing ties from these combinations. Retailers would further benefit from a device for packaging such combinations that can securely attach to these articles in a non-destructive way. The present invention satisfies these and other needs.

SUMMARY OF THE INVENTION

The present invention concerns a method for securing a tie to a folded shirt. The shirt has a row of buttons. The method includes the step of placing a first portion of the elongated body. The tie is dispensed on the folded shirt, with one portion secured proximately to the collar and a second portion depending downwardly along the buttons. The elongated body is wrapped around the folded shirt. The first portion of the elongated body is placed under the tie. The buttonhole is secured to one of the buttons of the row of buttons. A second portion of the elongated body is placed over the tie. The first end is attached to the strap at a first position displaced from the second end. The second end is attached to the strap at a second position displaced from the first end. As a result, the tie is seated between the first and second body portions and secured between the first and second positions.

The present invention also concerns a strap for securing a tie to a shirt. The strap includes an elongated body having first end and second ends and first and second scorelines. The scorelines are generally perpendicular to the length of the elongated body and define a central portion, a first side portion and a second side portion. The central portion is the portion of the elongated body positioned between the scorelines. The central portion has length sufficient to accommodate one dimension of a folded shirt. The first side portion is defined between the first scoreline and the first end and the second side portion between the second scoreline and the second end. When the lengths of the two side portions are combined, they result in a length greater than the length of the central portion.

The elongated body can be folded along the first and second scorelines. The first end is attachable to the second side portion and the second end is attachable to the first side portion. When these attachments are made, a channel, is defined by the elongated body between the first and second side portions (at their overlapping parts). The channel is sized for the placement of the tie therein. A buttonhole is placed on the first side portion.

DETAILED DESCRIPTION OF EXEMPLARY EMBODIMENTS

Figure 1:
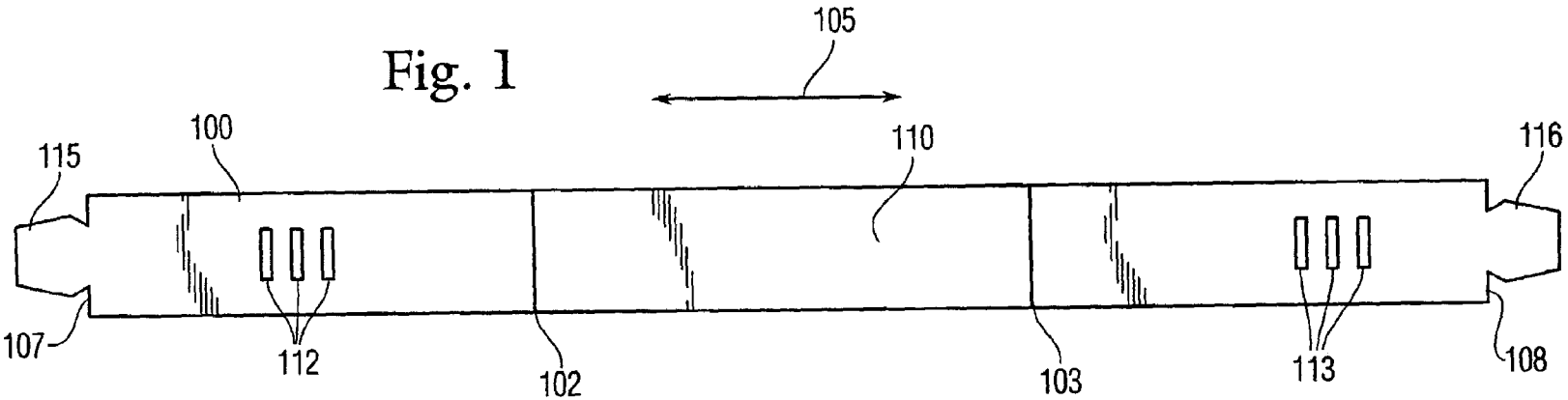
FIG. 1 is a depiction of a first embodiment of the present invention in an unfolded state.
Figure 2:
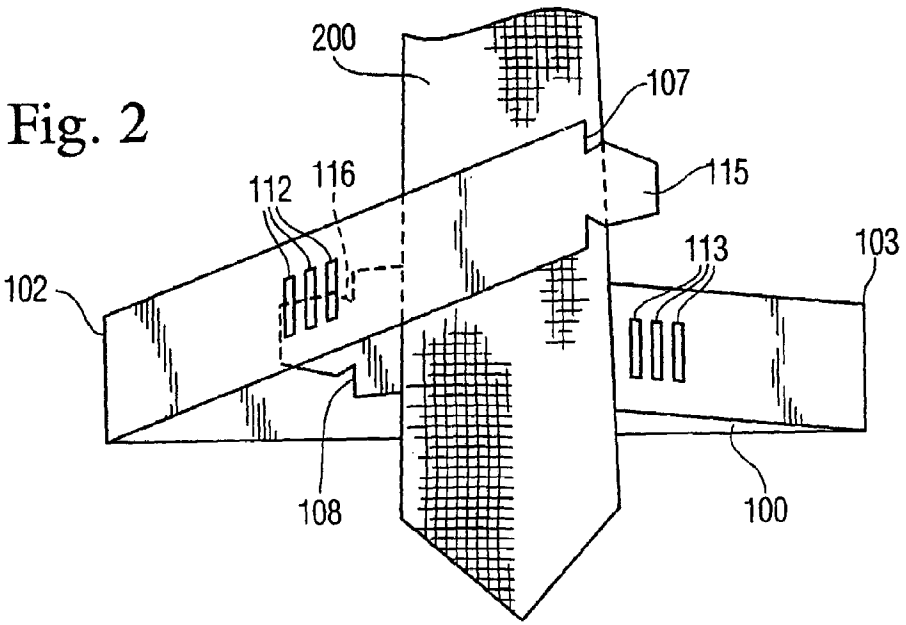
FIG. 2 is a depiction of the first embodiment in a folded state.

The main component of the present invention is the body 100, shown in FIG. 1 in an unfolded state and in FIG. 2 in a folded state. The body 100 folds along scorelines 102 and 103. The scorelines are indentations that are either created as part of the manufacture of the body or are the result of the folding of the body.

The body extends in horizontal direction, marked by arrow 105, between ends 107 and 108. The body may be manufactured in variety of materials. In a preferred embodiment, plastic is used. Also, in a preferred embodiment, the body is manufactured from a clear material in order to reveal a shirt and a tie beneath it. Furthermore, in a preferred embodiment, the body 100 includes indicia, for example, placed on the portion 110 between the scorelines 102 and 103. Indicia may include trade names and/or describe the merchandise with which the present invention is used.

The body 100 also includes a set of first lock-slots 112 and a set of second lock-slots 113. The two sets comprise one or more lock-slots each. Multiple lock-slots help accommodate shirts of different dimensions. A first lock-tab 115 is placed next to the first end 107 and a second lock-tab 116 is placed next to the second end 108.

The present invention is used in conjunction with a folded shirt (300 in FIG. 3) with a tie (200 in FIG. 2) attached to it. When folded along the scorelines 102 and 103, the body can be made to wrap around the shirt, as shown in FIG. 2. In a preferred embodiment, the tie is folded to span portions of the top and bottom surfaces of the shirt. The body is placed in a position so that it intersects the tie at least once (and preferably twice—on the top and the bottom of the folded shirt).

Figure 3:
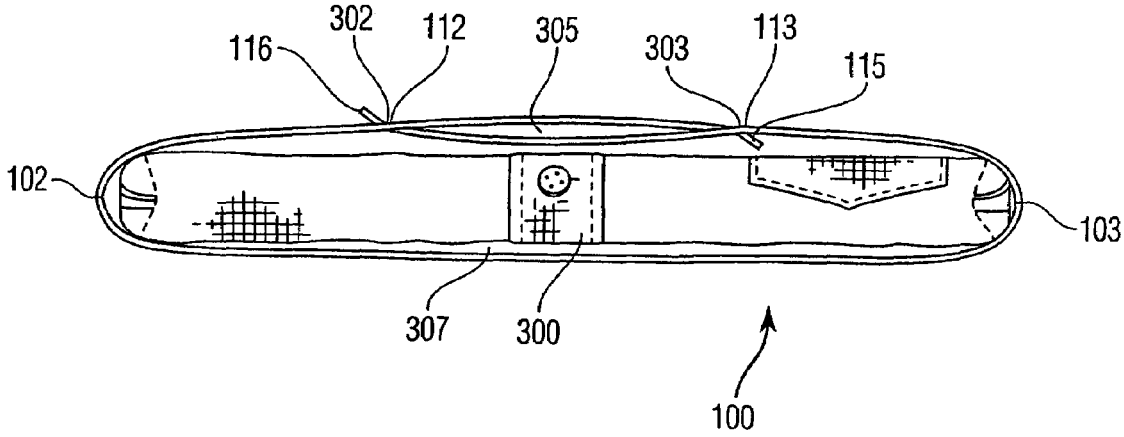
FIG. 3 is an end view of the first embodiment in a folded state.

When the body is folded, as shown in FIG. 2, the second lock-tab 116 is inserted in one of the first slots 112 and the first lock-tab 115 is inserted in one of the second slots 113. FIG. 3 shows a view from below of the body 100 wrapped around a folded shirt 300. There it can be seen that when lock-tab 116 inserted into lock-slot 112 a lock-joint 302 is formed. Similarly, when lock-tab 115 is inserted into lock-slot 113, lock-joint 303 is formed. The ends 107, 108 remain fixed to define the channel 305 because the lock tabs preferably include at least a portion that is larger than the lock slots. When these insertions are made, the channel 305 defined between the lock-joints 302 and 303 and portions of the body is suitable for the insertion of a tie therein. In a preferred embodiment the channel is so formed that it provides frictional resistance to the tie once a tie is placed therein. Thus, once a tie is placed within the channel one must exert a force on the tie in order to pull it out.

If the tie is placed so it intersects the body twice, then the other end of the tie is placed in the space between the body and the folded shirt 307.

Figure 4:
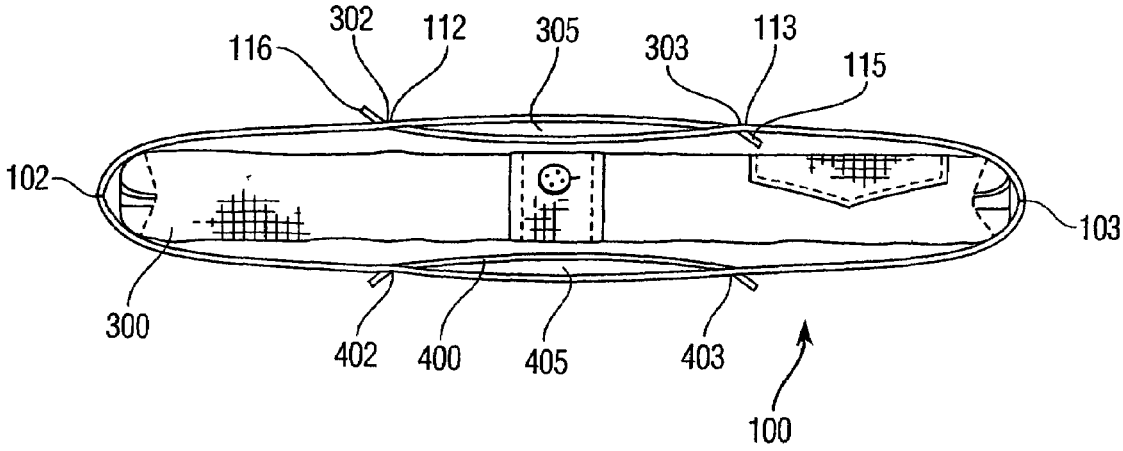
FIG. 4 is an end view of a variation of the first embodiment.

FIG. 4 depicts a different embodiment of the present invention. There, a strip 400 is added to the side of the folded body that is opposite to the channel 305. The strip 405 is attached to the body 100 by joints 402 and 403. These joints may be created by the described lock-tab and lock-joint method or by any other method, such as, for example, the use of glue. In FIG. 4, the strip 400 is placed between the body 100 and the folded shirt 300. It may, however be placed on the other side, so that the body 100 is between the strip 400 and the shirt 300. The strip helps form a second channel 405, which is also suitable for the placement of a tie therein. Thus, in cases where the tie is folded in such a way as to intersect the body twice, the tie is placed within the first channel 305 and within the second channel 405.

Figure 5A:
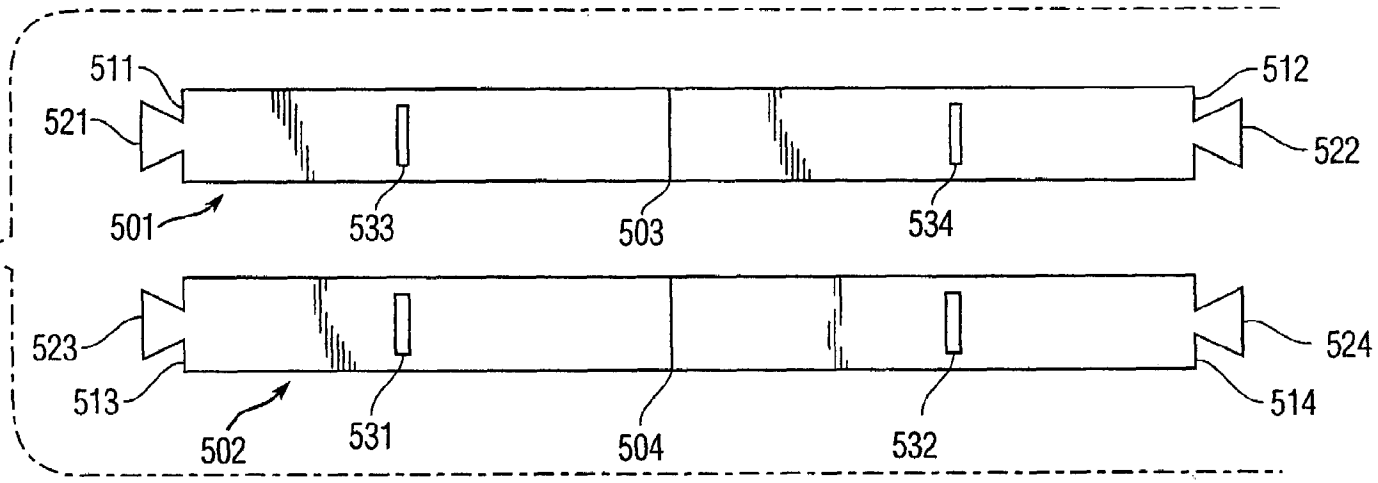
FIG. 5A is a depiction of a second embodiment of the invention in the unfolded state.
Figure 5B:
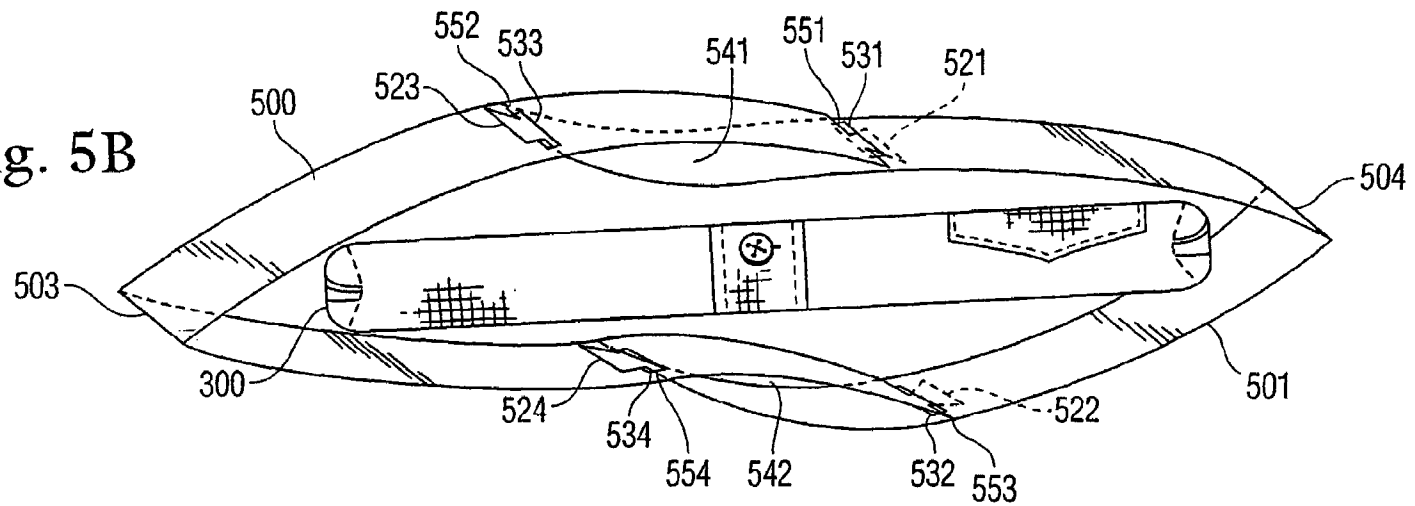
FIG. 5B is a depiction of the second embodiment of the invention in a folded state.

A second embodiment of the invention is depicted in FIGS. 5A and 5B. As seen in FIG. 5A, two elongated bodies 501 and 502 are used. Each elongated body comprises a single scoreline 503 and 504 which is perpendicular to the direction the body extends in. The first elongated body 501 extends between a first end 511 and a second end 512 and the second elongated body 502 extends between a third end 513 and a fourth end 514. There are first, second, third and fourth lock-tabs 521, 522, 523 and 524 placed adjacent to the first, second, third and fourth ends 511, 512, 513 and 514 respectively. Each elongated body comprises two lock-slots. The lock-slots of each elongated body are on alternate sides of its scoreline. First and second lock-slots 531 and 532 are positioned on the second elongated body 502. The first lock-slot 531 is proximate to third end 513, and the second lock-slot 532 is proximate to the fourth end 514. Third and fourth lock-slots 533 and 534 are positioned on the first elongated body 500. The third lock-slot 533 is proximate to first end 511, and the fourth lock-slot 534 is proximate to the second end 512.

The two elongated bodies are folded along their respective scorelines and wrapped around a folded shirt 300 as shown in FIG. 5B. The first lock-tab 521 engages the first lock-slot 531 and the third lock-tab 523 engages the third lock-slot 533 to form a first pair of lock-joints 551 and 552, respectively. The second lock-tab 522 engages the second lock-slot 532 and the fourth lock-tab 524 engages the fourth lock-slot 534 to form a second pair of lock-joints 553 and 554, respectively. After the engagements are made and the lock-joints are formed, first and second channels 541 and 542 are formed between the lock-joints and the two elongated bodies. These channels are suitable for the placement of a tie therein. In a preferred embodiment a tie is placed within one of the channels, folded along one of the sides of a folded shirt and placed within the other channel.

Figure 6:
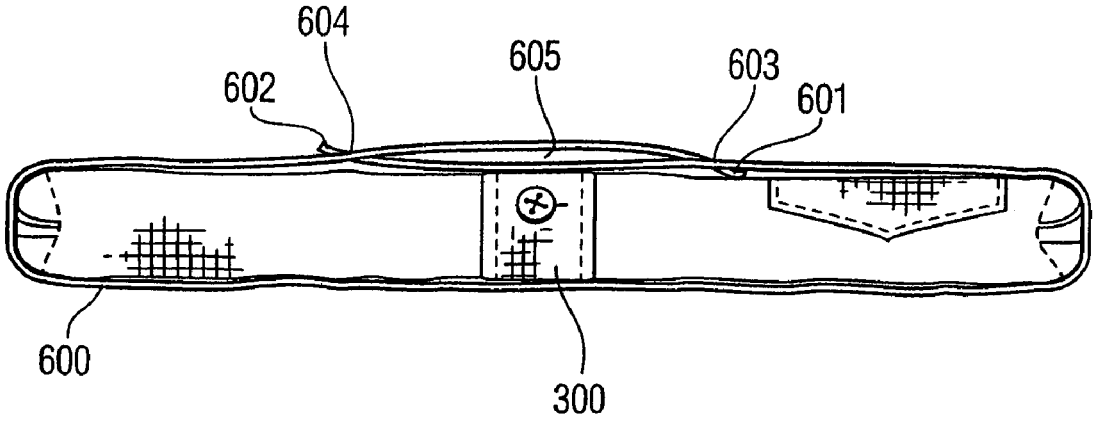
FIG. 6 is a depiction of a third embodiment of the present invention.

A third embodiment of the present invention is depicted in FIG. 6. A fabric elongated body 600 having first and second ends 601 and 603 is used. The elongated body 600 is wrapped around the folded shirt 300 in a way very similar to the way the elongated body 100 of the first embodiment is wrapped. But instead of using lock-tabs and lock-slots, the ends 601, and 602 are attached to binding points 603 and 604, the binding points being positioned on the elongated body. Thus, the elongated body 600 forms a main loop, or a fabric strap, around the folded shirt 300. A channel 605 sized for the placement of a tie therein is formed between the binding points and portions of the strap.

Figure 7:
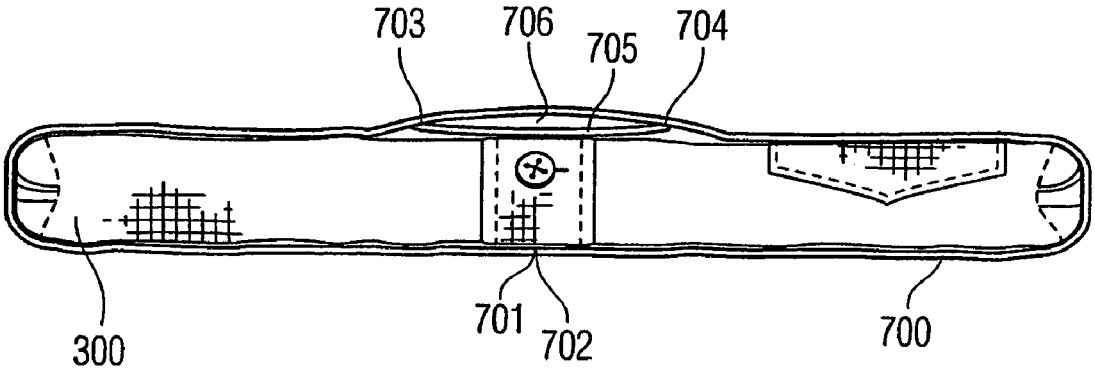
FIG. 7 is a depiction of a fourth embodiment of the present invention.

A fourth embodiment of the present invention is depicted in FIG. 7. In this embodiment a fabric elongated body 700 is used. The elongated body is made to form a main loop by attaching its ends 701 and 702. The main loop is suitable for the placement of a folded shirt 300 therein. An additional wall 705, composed, preferably of the same material as the elongated body 700, is attached to the elongated body 700 at two attachment points 703 and 704. A channel 706 is formed between the elongated body 700, the wall 705 and the attachment points 703 and 704. The channel 706 is suitable for the placement of a tie therein.

In use, a tie is secured to a folded shirt without requiring that the shirt and tie combination be enclosed in a bag, box or other cover. Such enclosure is seen as detrimental to the display characteristics of the shirt and tie combination, because customers often want to feel the fabric of the shirt and/or tie before they buy the combination.

The tie is attached to the neck area of a folded shirt. There are several known methods for effecting such attachment. Pins, or a plastic device may be used for this purpose. The tie is then positioned along the buttons of the folded shirt. A strapping device as described herein is wrapped around the shirt. The tie is inserted into the strapping device. The wrapping and inserting steps are optionally performed simultaneously. This can be achieved, for example, when using some of the strapping devices described above. More specifically, referring to FIG. 2, the tie 200 can be placed within the strapping device 100 (i.e. the elongated body), while the action of wrapping the folded shirt with the strapping device 100 is ongoing, that is, while the lock-tab 116 is being placed in a lock-slot 112 and the lock-tab 115 is about to be placed in a lock-slot 113.

Figure 8:
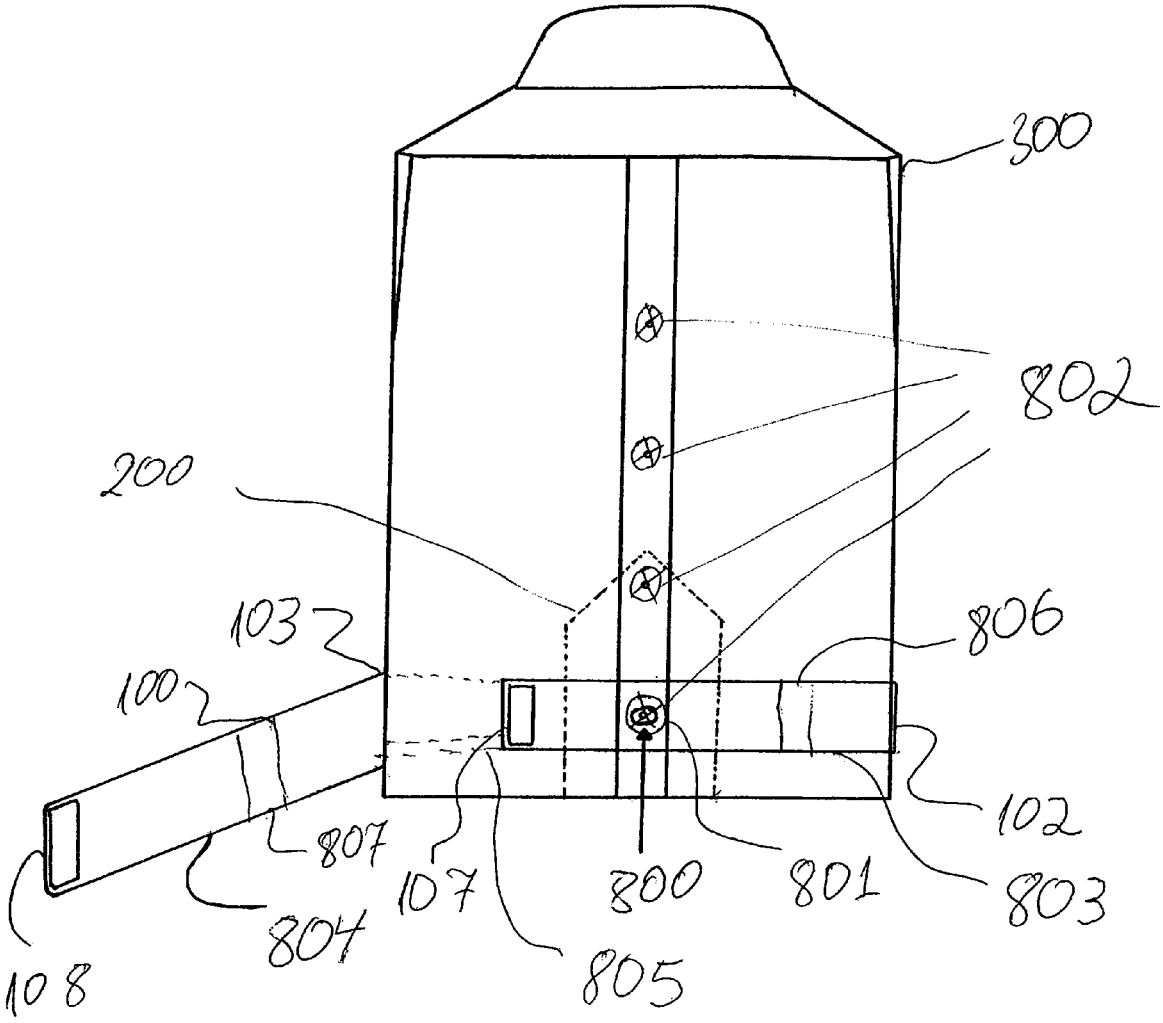
FIG. 8 is a depiction of a fifth embodiment of the present invention.

A further embodiment of the present invention is shown in FIG. 8. FIG. 8 shows the back side of a folded shirt 300. The shirt includes a row of buttons 802. A tie 200, is attached to the folded shirt. The tie is folded along the bottom of the folded shirt so that a portion of it is disposed along the back of the folded shirt as shown in FIG. 8. A strap is placed around the folded shirt. The strap comprises an elongated body 100 having first and second scorelines, as shown in FIGS. 1 and 2 and described above, the elongated body is foldable along the scorelines.

A first side portion 803 of the elongated body is defined between the first scoreline 102, and the first end 107. A buttonhole 800 is placed through the first side portion. The buttonhole is sized to accommodate one of the buttons of the row of buttons 802. A second side portion 804 is defined between the second scoreline 103 and the second end 108. A central portion 805 is defined between the first and second scorelines 102 and 103. In FIG. 8, the central portion 805 is hidden, as it extends across the front side of the folded shirt. The central portion has a length sufficient to accommodate one dimension of the folded shirt, i.e., the transverse dimension relative to the buttons 802 on the front side of the shirt. Thus, in FIG. 8, the central portion accommodates the width of the folded shirt.

The combined length of the first and second side portions is greater than that of the central portion. Therefore, when the elongated body is folded along the scorelines, the first and second side portions overlap. It is preferred but not required that the first and second side portions are of equal length. After folding the elongated body, the first end 107 is attached to the second side portion 804 at a position 807 which is displaced from the second end 108. Similarly, the second end 108 is attached to the first side portion 803 at a position 806 which is displaced from the first end 107. The attachments may be made in various manners, including for example, the use of glue, stapling, and hot stamping. Optionally, areas of the body in proximity to the first and second ends 107 and 108 and the first and second attachment positions 806 and 807 are roughened to facilitate the application of glue thereon. When the attachments are made, a channel is formed between the overlapping portions of the first and second side portions. The channel is suitable for the placement of a tie therein.

In use, an elongated body, such as the one shown in FIG. 8, is provided. A tie is disposed on a folded shirt. One portion of the tie is secured proximate to the collar and a second portion depends downwardly along the row of buttons. The elongated body is wrapped around the folded shirt. The first side portion can be placed under the tie. The buttonhole 800 is preferably secured to a button 801, which belongs to the row of buttons 802. The second side portion 804 can be placed over the tie. The first end 107 is attached to the elongated body at a first position 807 which is displaced from the second end. The second end 108 is attached to the elongated body at second a position 806 which is displaced from the first end. Thus, the tie may be placed between the first and second side portions and secured between the first and second positions before or after the first and second ends are attached or after one of these ends has been attached. The first and second attachment positions can be spaced so as to permit a tie to be seated flat between them.

The invention has been described in connection with particular embodiments thereof but is more broadly defined by the claims appended hereto.

I claim:

1. A method for securing a tie to a folded shirt having a row of buttons thereon, comprising the steps of:

providing an elongated body having first and second ends, a first portion, a second portion, and a buttonhole through the first portion;

wrapping the elongated body around the folded shirt;

securing the buttonhole of the first portion of the elongated body to one of the buttons of the row of buttons;

disposing the tie on the folded shirt with one part secured proximate to the collar and a second part depending downwardly along the row of buttons;

placing the tie over the first portion of the elongated body;

attaching the first end to the elongated body at a first position which is displaced from the second end; and attaching the second end to the elongated body at second a position which is displaced from the first end, whereby the second portion overlies the tie and the tie is seated between the first and second portions and secured between the first and second positions.

2. The method of claim 1, wherein the first and second positions are spaced from one another so as to permit the tie to be seated flat between the first and second body portions.

3. For use with a shirt and tie combination, a strap comprising:

an elongated body having first end and second ends;

first and second scorelines extending generally perpendicular to a length of the elongated body and defining a central portion between the scorelines, and first and second side portions between the first end and the first scoreline and the second end and the second scoreline, respectively, the central portion having a length sufficient to accommodate one dimension of a folded shirt, and the first and second side portions having a combined length greater than the length of the central portion;

wherein the elongated body is foldable along the first and second scorelines, the first end is attachable to the second side portion and the second end is attachable to the first side portion;

a channel, defined by the first and second side portions when the first and second side portions are attached to the second and first ends, respectively, the channel being sized for the placement of the tie therein; and a buttonhole through the first side portion.

4. The strap of claim 3, wherein the first and second ends are attached to the second and first side portions, respectively.

5. The strap of claim 4, wherein the first and second ends are glued to the second and first side portions, respectively.

6. The strap of claim 3, wherein the strap is a clear material.

7. The strap of claim 3, further comprising indicia on the central portion.

8. The strap of claim 3, wherein the first and second side portions each have the same length.

* * * * *